US007004767B2

(12) United States Patent
Kim

(10) Patent No.: US 7,004,767 B2
(45) Date of Patent: Feb. 28, 2006

(54) HIGH-SPEED CABLE CONNECTOR WITH IMPROVED GROUNDING

(75) Inventor: Jung Hoon Kim, Euwang (KR)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/508,851

(22) PCT Filed: Mar. 26, 2003

(86) PCT No.: PCT/US03/09010

§ 371 (c)(1),
(2), (4) Date: Sep. 24, 2004

(87) PCT Pub. No.: WO03/084003

PCT Pub. Date: Oct. 9, 2003

(65) Prior Publication Data

US 2005/0148240 A1 Jul. 7, 2005

(30) Foreign Application Priority Data

Mar. 26, 2002 (KR) ..... 10-2002-0016336

(51) Int. Cl.
*H01R 13/648* (2006.01)

(52) U.S. Cl. ..... 439/95; 439/607

(58) Field of Classification Search ..... 439/95, 439/607–610

See application file for complete search history.

(56) References Cited

U.S. PATENT DOCUMENTS

| | | | | |
|---|---|---|---|---|
| 5,240,424 | A * | 8/1993 | Honma et al. | 439/95 |
| 5,588,851 | A * | 12/1996 | Morlion et al. | 439/108 |
| 5,632,634 | A * | 5/1997 | Soes | 439/101 |
| 6,074,223 | A * | 6/2000 | Huang | 439/95 |
| 6,520,781 | B1 * | 2/2003 | Koide et al. | 439/97 |
| 6,641,438 | B1 * | 11/2003 | Billman | 439/608 |
| 6,652,296 | B1 * | 11/2003 | Kuroda et al. | 439/95 |
| 6,702,616 | B1 * | 3/2004 | Chang et al. | 439/607 |
| 6,857,899 | B1 * | 2/2005 | Reed et al. | 439/497 |

* cited by examiner

*Primary Examiner*—Gary Paumen
(74) *Attorney, Agent, or Firm*—Thomas D. Paulius

(57) ABSTRACT

A high-speed cable connector includes a cable holder fixed to ends of cables to locate and hold the cable in a connection position and terminals that are connected at one end to wires of the cable extending out of the cable holder. The terminals include one grounding terminal connected to a grounding terminal of the cable. The connector has a housing that has an upper body and a lower body, between which the cable holder and terminals are seated, the upper body having an upper grounding hole extending through the upper body, the lower body having a lower grounding hole extending through the lower body and formed under the upper grounding hole. The connector housing includes a number of mating holes corresponding to the number of cable lead wires, the mating holes are formed through a front end of the lower body so that a mating connector can be connected with the terminals through the mating holes. The connector has a grounding shell covering upper and lower surfaces of the housing, the grounding shell having a front end with openings corresponding to the mating holes of the housing, the grounding shell being connected to the grounding terminal, thereby grounding the connector assembly.

11 Claims, 6 Drawing Sheets

HIGH-SPEED CABLE CONNECTOR WITH IMPROVED GROUNDING

BACKGROUND OF THE INVENTION

The present invention relates generally to a connector assembly for a high-speed communication cable, and more particularly to a connector assembly for a high-speed communication cable, elements of which can be collectively assembled after being individually manufactured, and which can be then stacked on and assembled with other connector assemblies having the same construction.

As is generally known in the art, apparatuses such as an exchange relayed only voice signals at the initial stage but are now required to relay not only voice signals but also binary data including image information. Each of such apparatuses comprises a plurality of circuit blocks including a large number of Printed Board Assemblies (hereinafter, referred to as PBAs) in order to relay voice and data of multiple subscribers. Further, as the size of relayed information increases, such apparatuses are required to transmit data at a higher speed, accommodate as many subscribers as possible, and process data at an ultra high speed.

As a result, signals transmitted between circuit blocks and PBAs in such apparatuses have predetermined frequencies, such as frequency bands over 240 MHz, and the volumes of the apparatuses are decreasing nowadays in order to reduce areas taken by the apparatuses.

Further, in the apparatuses as described above, the circuit blocks and PBAs are electrically connected with each other through transmission cables, which are connected with or separated from the circuit blocks or PBAs by means of cable assemblies. That is, cable assemblies are provided at ends of transmission cables, so as to enable the transmission cables to be easily connected with or separated from the circuit blocks or PBAs of the apparatuses. As the volumes of transmission apparatuses decrease, the volumes of the cable assemblies as described above should be reduced as much as possible while enabling the cable assemblies to transmit high frequency signals above 240 MHz, which are processed by the circuit blocks or PBAs, without distortion.

According to the restriction to the volumes as described above, unshielded-type cable assemblies having a pitch of 2 mm and shielded-type cable assemblies which enable high frequency signals to be transmitted without distortion have been proposed. However, in manufacturing these cable assemblies, nodes connected to cables are inserted in elements manufactured by a first injection molding and are then subjected to a second injection molding. Therefore, the conventional cable assemblies are problematic in that the manufacturing methods thereof are complicated and defective ratio of the cable assemblies is high.

SUMMARY OF THE INVENTION

Accordingly, the present invention has been made to solve the above-mentioned problems occurring in the prior art, and an object of the present invention is to provide a connector assembly for a high-speed communication cable, elements of which can be collectively assembled after being individually manufactured, and which can be then stacked on and assembled with other connector assemblies having the same construction.

It is another object of the present invention to provide a connector assembly for a high-speed communication cable and a manufacturing method thereof, in which the final insert-molding step of the conventional method is replaced by an assembling step, thereby reducing the manufacturing cost, simplifying the manufacturing process, and improving the productivity.

It is another object of the present invention to provide a connector assembly for a high-speed communication cable and a manufacturing method thereof, which can be employed in the field of Telecom at high speed applications.

In order to accomplish this object, there is provided a connector assembly for connecting at least one cable for high-speed communication with a corresponding connector of another communication apparatus, the connector assembly comprising: a cable holder fixed to one end of the cable, so as to locate and hold the incoming cables at their regular positions; terminals that have one end connected to single lead wires of the cables which extend out of the cable holder, the terminals including one grounding terminal connected to a grounding wire; an insulative housing including upper and lower body portions, between which the cable holder and the terminals are seated, the upper body having an upper grounding hole which extends through it, the lower body having a lower grounding hole which extends through it and which is preferably aligned with the upper grounding hole, the lower body having mating openings that correspond to the number of the cable wires and which are formed in a front end of the lower body so that a mating connector may be connected to the terminals of the connector through the mating openings; and a grounding shell covering both upper and lower surfaces of the housing upper and lower body portions, the grounding shell having a front end which has openings corresponding to the mating openings, the grounding shell being connected to the grounding terminal, thereby grounding the connector assembly.

The housing lower body further comprises a plurality of partitions extending longitudinally of the housing and the terminals are disposed between the partitions. The upper body and the lower body are fused to each other by means of ultrasonic wave. The upper body and the lower body each include assembly holes, and the cable holder has assembly lugs protruding from upper and lower surfaces thereof, so that the assembly lugs are inserted into the assembly holes, thereby preventing the cable holder from moving with respect to the housing after the upper body and the lower body are assembled together. The terminals and the lead wires may be spot-welded to each other.

The grounding shell comprises an upper shell plate having an upper grounding arm that is formed in the central area of the upper shell plate and is bent downward therefrom. This upper grounding arm contacts the grounding terminal through the upper grounding hole. The grounding shell further includes a lower shell plate with a lower grounding arm that is centrally formed in the lower shell plate and which extends upwardly into contact with the grounding terminal by way of the lower grounding hole. Lastly, the grounding shell includes connection bridges that connect together the front ends of the upper and lower shell plates while defining mating openings between the connection bridges and plates. The upper and lower grounding arms are spot-welded to the grounding terminal in a threefold arrangement.

The connector assembly may further comprise a stacking means for enabling the connector assembly to be stacked on and assembled with another connector assembly having a construction equal to that of the connector assembly.

The stacking means comprises: stacking protuberances protruding in lateral directions from the lower body; shell attachment pieces protruding in lateral directions from the upper and lower plates of the grounding shell, being bent downward and outward, and being attached to upper and lower surfaces of the stacking protuberances; and a stacking member including at least one clamp, the clamp having a clamp hole extending in a horizontal direction, in which the stacking protuberances and the shell attachment pieces are inserted.

The stacking member comprises a plurality of clamps having an equal construction, which are stacked and attached on each other through attachment between upper and lower surfaces of the clamps.

According to another aspect of the present invention, there is provided a method of manufacturing a connector assembly for high-speed communication cable, the method comprising the steps of: exposing lead wires by eliminating coats of each cable of a cable assembly, and then fixing said each cable to a cable holder by molding; spot-welding first ends of connection nodes with the lead wires of said each cable; locating second ends of the connection nodes in connection holes of a lower body of a housing, and then assembling an upper body of the housing with the lower body; and assembling a grounding shell with the housing so that the grounding shell covers upper and lower surfaces of the housing. In this case, the upper body and the lower body are fused to each other by means of ultrasonic wave.

These and other objects, features and advantages of the present invention will be clearly understood through a consideration of the following detailed description.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Figure 1:
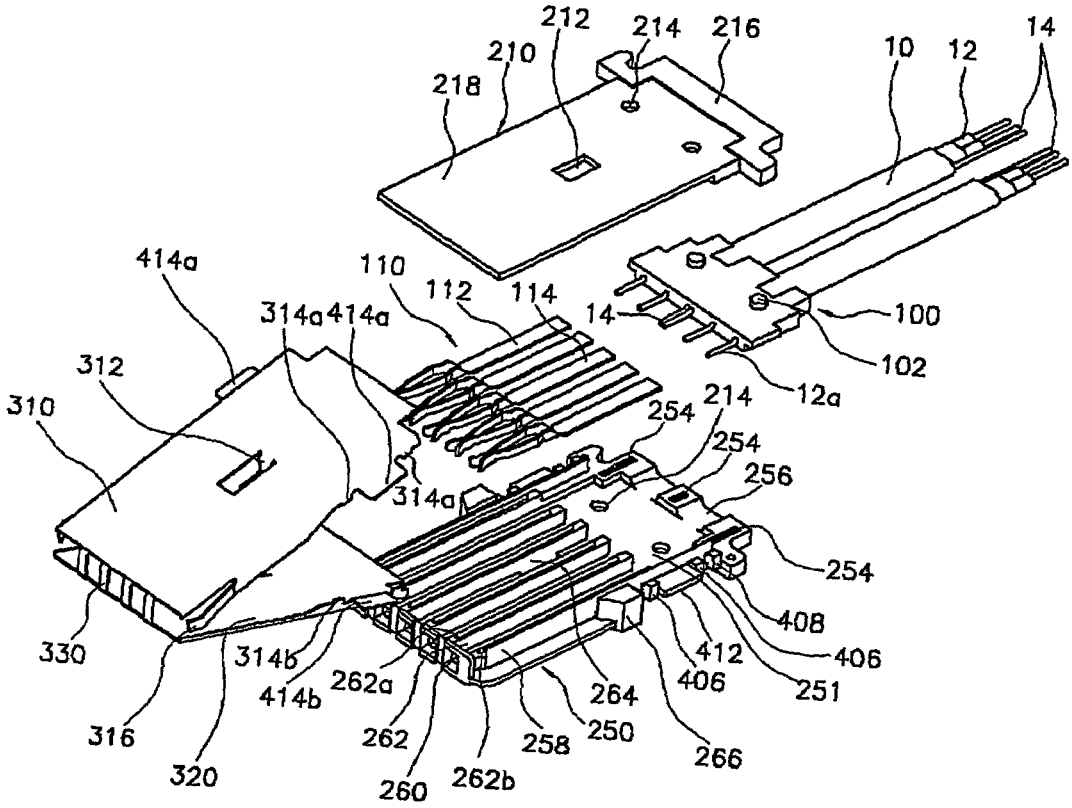
FIG. 1 is an exploded perspective view of a high-speed communication cable connector assembly constructed in accordance with the principles of the present invention.
Figure 2:
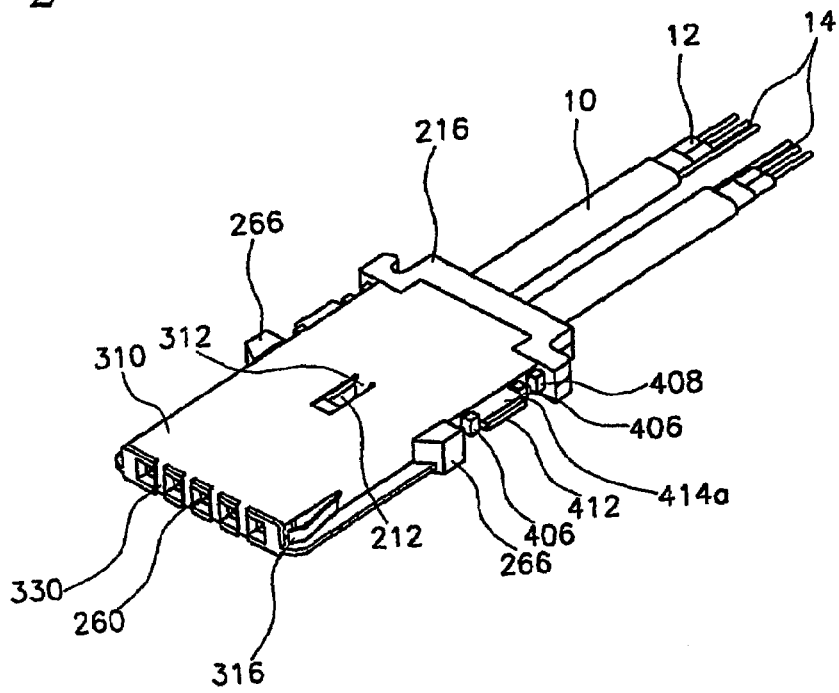
FIG. 2 is a perspective view of the connector assembly of FIG. 1, but in an assembled state.
Figure 3:
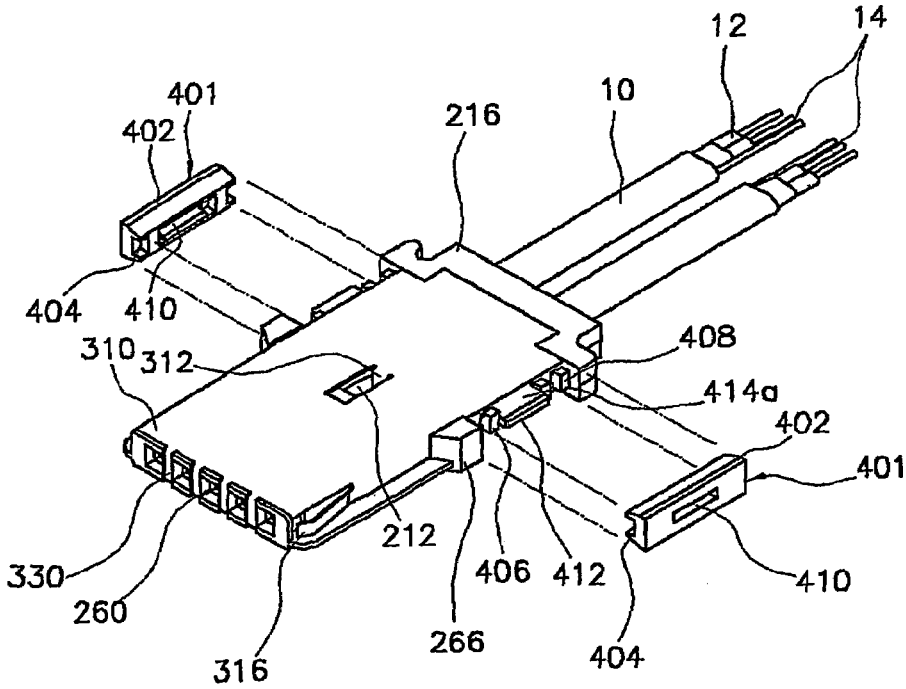
FIG. 3 is an exploded perspective view of the connector assembly of FIG. 2, illustrating the stacking member clamps separated from the connector assembly.
Figure 4:
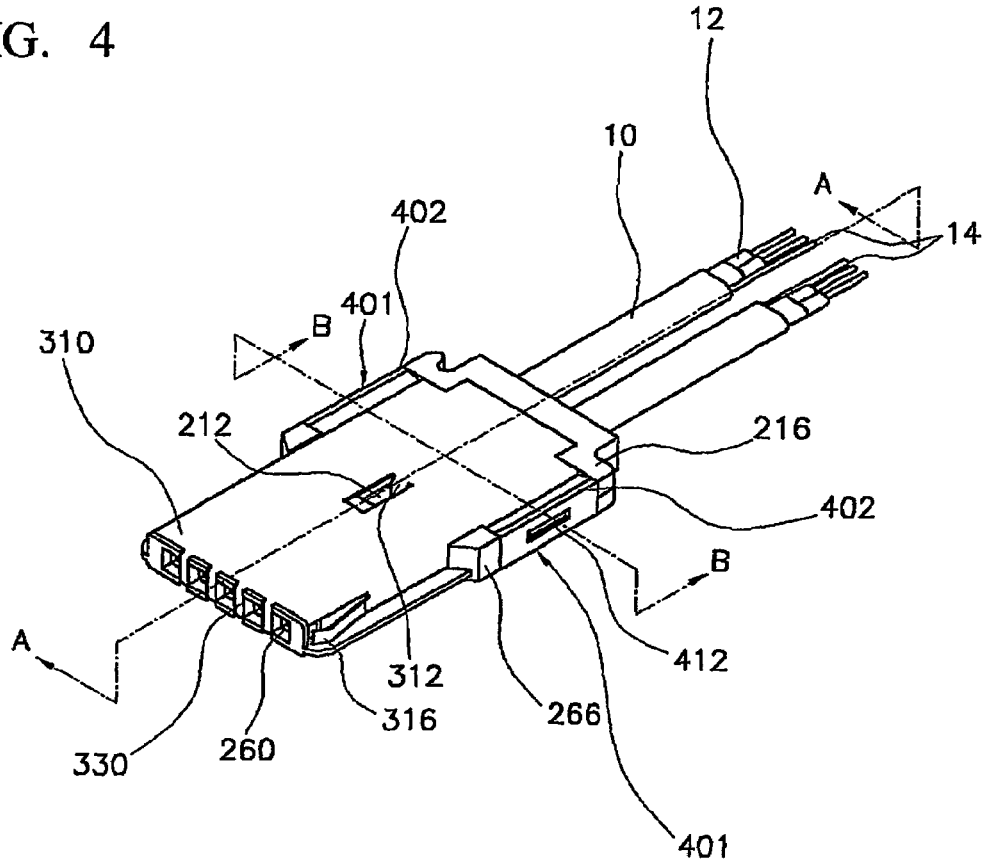
FIG. 4 is the same view as FIG. 3, but illustrating the stacking member clamps assembled to the connector assembly.
Figure 5:
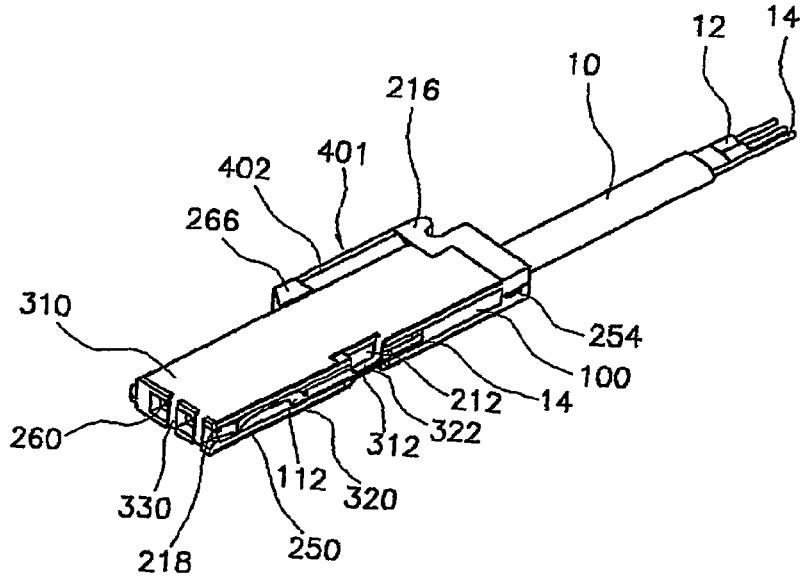
FIG. 5 is a sectional view of FIG. 4, taken along line A—A thereof.
Figure 6:
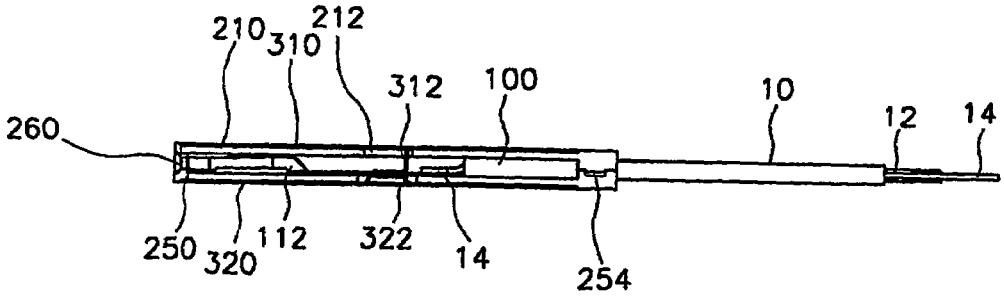
FIG. 6 is a side elevational view of the connector assembly shown in FIG. 4.
Figure 7:
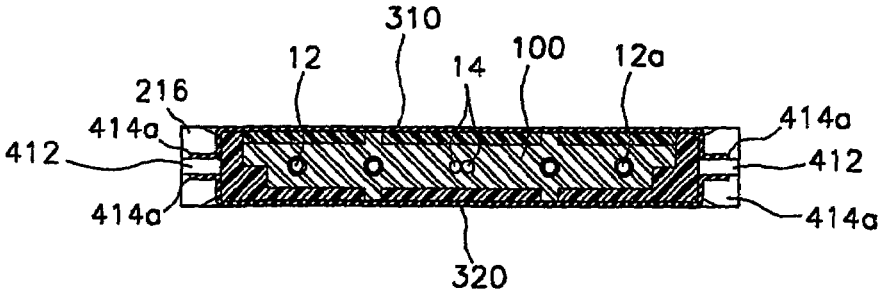
FIG. 7 is a sectional view of FIG. 4, taken along line B—B thereof.
Figure 8:
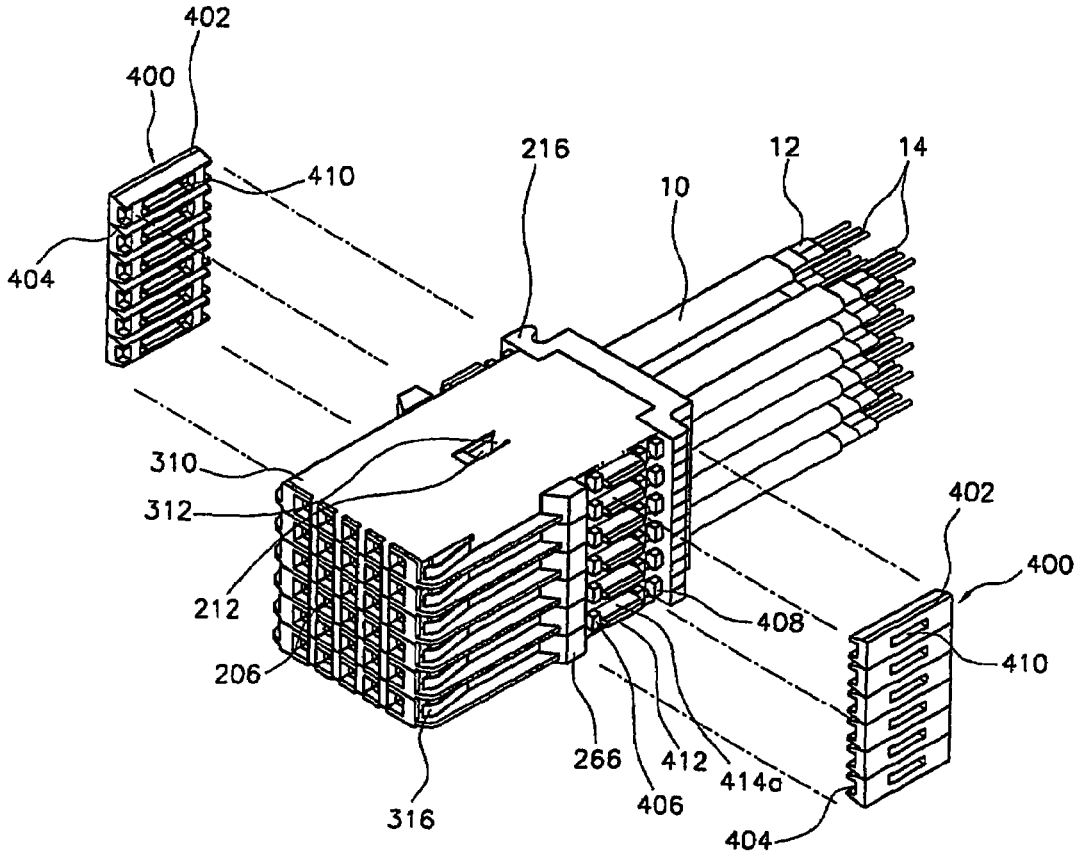
FIG. 8 is an exploded perspective view of multiple part connector assembly in which individual connector assemblies are stacked and assembled together by stacking members; and, FIG. 9 is the same view as FIG. 8, but illustrating the connector assemblies stacked and assembled together by stacking members.
Figure 9:
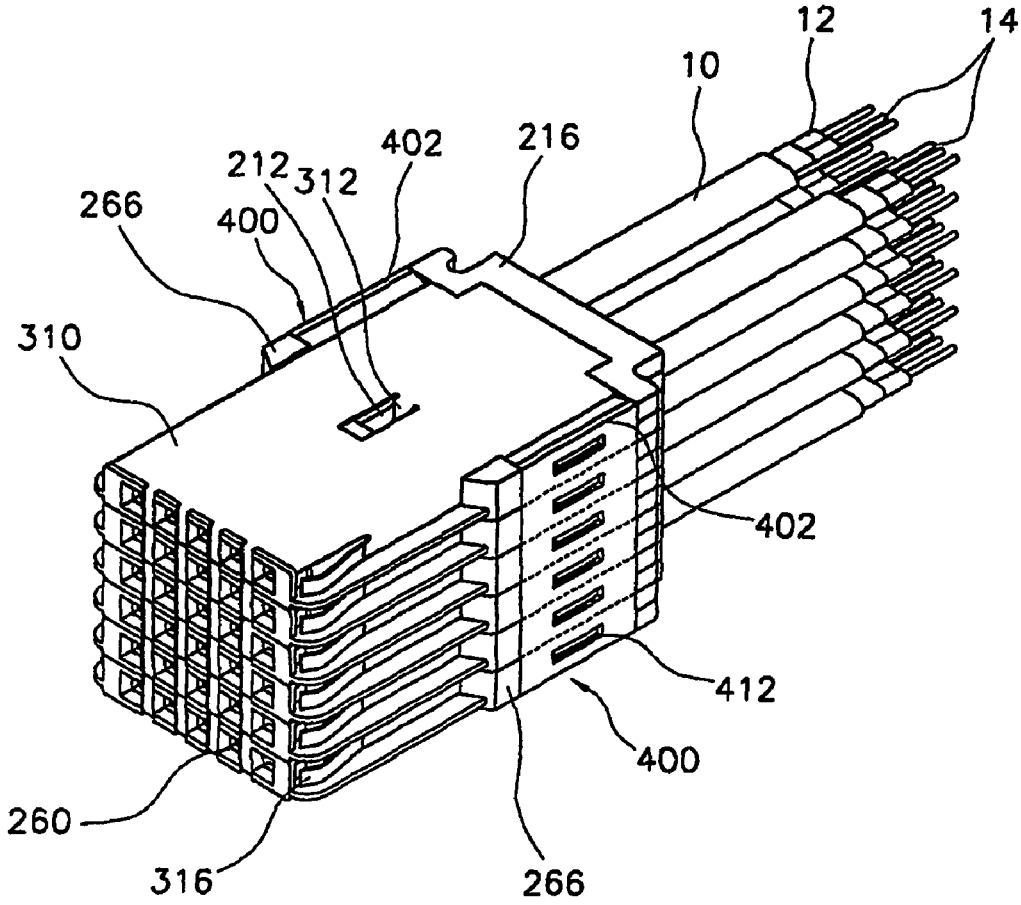

The preferred embodiments of the present invention will be described in detail with reference to the accompanying drawings. FIGS. 1 and 2 show a process of assembling a connector assembly for a high-speed communication cable according to the present invention, and FIGS. 3 and 4 show a process of assembling stacking members with the connector assembly shown in FIG. 2. Further, FIGS. 5, 6, and 7 are sectional views and elevational views showing the interior of the connector assembly shown in FIG. 4. FIGS. 8 and 9 are perspective views showing the manner of stacking and assembling multiple connector assemblies for high-speed communication cables by means of six pairs of stacking members.

A connector assembly for a high-speed communication cable according to the present invention includes a cable (or wire) holder 100, a terminal assembly 110, a housing having an upper body 210 and a lower body 250, a grounding shell 300, and a stacking means.

In fixing the cables 12 to the cable holder 100, which seats and holds the cable 12 in its regular position in the housing, lead wires 12*a* exposed by stripping off end portions of their insulative coverings, and the cables 12 are seated in their regular positions in the cable holder 100 and are then fixed to the cable holder 100 by molding so that portions of the lead wires 12*a* protrude out of the cable holder 100. The cable holder 100 has a plurality of, preferably four assembly lugs 102 protruding from upper and lower surfaces thereof. These lugs 102 are inserted through assembly holes 214 of the upper body 210 and the lower body 250, so that the cable holder 100 can be securely seated and held in the housing 210 and 250. The parts may then be further fastened together by way of plastics or ultrasonic welding, or any other suitable fastening means known in the art and used in such connector assemblies. The lead wires 12*a* protrude forward from the front end of the cable holder 100 and are connected with the terminal assembly 110 as described below.

The terminal assembly 110 is an element which is electrically connected with a corresponding connecter of an external communication apparatus. The terminal assembly 110 have flat termination portions at one end thereof, to which the lead wires 12*a* are spot-welded, and on the other ends thereof, two bent metal arms opposed to each other so that each of connector pins of the external mating connecter can be elastically inserted into the two bent metal sheets. Further, the five terminals include four signal terminals 112 and one grounding terminal 114 located in the center of the signal terminals 112.

The housing includes an upper body 210 and a lower body 250. The upper body 210 includes an upper body plate 218, the holder-assembling holes 214, an upper grounding hole 212, and an upper body grip 216. The upper body plate 218 is shaped like a plate and has two assembly holes 214 which are formed at rear portions thereof and extend vertically through the upper body plate 218. Further, the upper grounding hole 212 also extends vertically through the upper body plate 218, and the upper body grip 216 is fixed to the rear end of the upper body plate 218.

The assembly lugs 102 protruding upward from the upper surface of the cable holder 100 are inserted in the assembly holes 214, thereby enabling the cable holder 100 and the upper body 210 to be easily assembled with each other and preventing the cable holder 100 from moving in the housing after they are assembled.

The upper grounding hole 212 is formed at a location directly above the grounding node 114 described above, so as to enable an upper grounding piece 312 of the grounding shell 300 to be easily connected with the grounding terminal 114. That is, the upper grounding piece 312 is inserted through the upper grounding hole 212 and connected with the grounding terminal 114 disposed in the housing 210 and 250.

In the meantime, the lower body 250 includes side walls 258, connection holes 260, partitions 262, partition protuberances 262*a*, a lower grounding hole 264, holder-assembling holes 214, wings 266, first stacking protuberances 408, second stacking protuberances 412, third stacking protuberances 406, a lower body grip 268, housing-assembling grooves 254, cable assembly seats 256, a cable holder seat 251, and connection node seats 262*b*.

Two side walls 258 protruding vertically upward and extending longitudinally are formed at opposite sides of the lower body 250. Two partitions 262 are disposed in contact with inner surfaces of the side walls 258, and four partitions 262 having the same length are disposed at regular intervals between the two partitions 262 in contact with inner surfaces of the side walls 258. Therefore, the grounding terminal 114 and the signal terminals 112 described above are seated in the five spaces formed between the partitions 262, that is, in the connection node seats 262. In this case, the lengths of and the intervals between the partitions 262 are determined by the seated grounding terminal and signal terminals, 114 and 112.

Further, the lower grounding hole 264 is formed vertically through the bottom of the central terminal seat 262*b* from among the terminal seats 262 formed between the partitions 262 described above. That is, the lower grounding hole 264 is formed directly under the upper grounding hole 212 of the upper body plate 218. Therefore, the grounding terminal 114 is seated in the central connection node seat 262*b* formed under the upper grounding hole 212.

The connection holes 260 horizontally extending are formed through front ends of the partitions 262, that is, through the front end of the lower body 250, so that corresponding connector pins of an external apparatus can be inserted through the connection holes 260. In this case, extensions of the partitions 262 form a front wall through which the connection holes 260 are formed. That is, the partitions 262 extend from the connection holes 260 to the front end of the cable holder 100.

Each the partition 262 has the partition protuberance 262*a* extending in the longitudinal direction and protruding upward from the upper end of the partition 262. The partition protuberances 262*a* are inserted in partition grooves (not shown) formed at the lower surface of the upper body plate 218 of the upper body 210, thereby enabling the upper body 210 and the lower body 250 to be more firmly assembled.

The cable holder seat 251 for receiving the cable holder 100 is formed behind the partitions 262. The cable holder seat 251 has a shape corresponding to the shape of the cable holder 100, so that the cable holder 100 can be fitly inserted in the cable holder seat 251. In the present embodiment, rear portions of the upper body 210 and the lower body 250 are angularly cut to have a shape corresponding to the shape of the rear portion of the cable holder 100.

Further, the cable holder seat 251 preferably has two assembly holes 214 in which two assembly lugs (not shown) formed at the lower surface of the cable holder 100 are inserted. The holder-assembling holes 214 guide the cable holder 100 to be easily seated in the cable holder seat 251 at the initial assembling stage and prevent the cable holder 100 from moving in the housing after the assembling. The cable assembly seats 256 each preferably have a concave shape in the lower body gripping area 268 formed at the rear end of the lower body 250 so that cable assemblies 10 sit in the cable assembly seats 256. Similar cable assembly seats 256 are also likewise formed in the upper body grip 216 of the upper body 210.

Assembly lugs (not shown) protrude from the lower surface of the upper body gripping portion 216 of the upper body 210, and the assembly grooves 254 each having a shape corresponding to the shape of the assembly lugs are formed on the upper surface of the lower body gripping portion 268 of the lower body 250. When the upper body 210 and the lower body 250 are assembled with each other, the assembly lugs are inserted in the assembly grooves 254. Therefore, when the partition protuberances 262*a* of the lower body 250 and the housing-assembling protuberances are inserted in the partition-assembling grooves (not shown) of the upper body 210 and the housing-assembling grooves 254 of the lower body 250, respectively, the upper body 210 and the lower body 250 are assembled with each other.

Two wings 266 protrude in lateral directions from the opposite side walls 258 of the lower body 250. The first stacking protuberances 408, the second stacking protuberance 412, and the third stacking protuberances 406 are formed behind each of the wings 266. The first stacking protuberance 408 includes a horizontal portion outward extending from a portion behind the wing 266 and a vertical portion extending upward and downward from the outer end of the horizontal portion. The first stacking protuberances 408 are located within clamp holes 404 formed at opposite ends of an inner surface of a stacking member 400 which will be described later.

The second stacking protuberances 412 protrude outward from the side walls 258 and inserted in clamp grooves 410 which will be described later. The third stacking protuberances 406 are similar in shape of the first stacking protuberance 408 shown and are formed at both sides of the second stacking protuberance 412 and are also inserted in the clamp groove 410 of the stacking member 400. The first stacking protuberance 408, the second stacking protuberance 412, the third stacking protuberance 406, and the stacking member 400 will be described later again. Further, the upper body 210 and the lower body 250 are fused to each other by means of ultrasonic wave, so as to reinforce the assemblage and the cable-holding.

The grounding shell 300 is an element which forms the external appearance of the connector assembly for a high-speed communication cable and is connected with the grounding terminal 114 in the housing so as to enable the connector assembly to be grounded. The grounding shell encompasses the entire top and bottom surfaces of the connector housing and provides a reference ground through the terminal area and the cable terminal areas of the connector. The grounding shell 300 is preferably formed form a single sheet of conductive material, such as sheet metal or the like and it includes upper shell plate 310, a lower shell plate 320, connection bridges 330 interconnecting the two shell plates together, an upper grounding arm 312, a lower grounding arm 322, upper shell plate protuberances 314*a*, lower shell plate protuberances 314*b*, and elastic flaps 316. The grounding shell extends from the front mating face of the connector housing to over the cable holder 100. In this manner is provides complete shielding to the inner signal terminals of the housing. Preferably, both the upper and lower grounding plates 310, 320 have equal lengths.

The upper shell plate 310 is shaped like a plate and has the upper grounding arm 312 formed at a central portion of the upper shell plate 310, which is cut and bent downward from the surrounding portion of the upper grounding arm 312. Since the upper grounding arm 312 is bent downward in a shape of the letter L as described above, the upper grounding arm 312 is inserted through the upper grounding hole 212 of the upper body 210 and electrically connected and spot-welded to the grounding terminal 114 seated in the connection node seat 262*b*, thereby enabling the connector assembly to be grounded.

Meanwhile, the upper shell plate 310 has opposite side portions bending downward from a horizontal central portion of the upper shell plate 310. A portion of each side portion of the upper shell plate 310 at the front side thereof is separated and protrudes outward with a predetermined angle from the horizontal central portion of the upper shell plate 310, so as to form the side elastic arm 316 in a cantilevered fashion which can elastically move in a direction to the top and bottom planes of the upper and lower grounding plates 310, 320. When the connector assembly is coupled with an opposing mating connector, the elastic arm 316 applies an elastic force to the mating connector in the outward direction, thereby preventing the connector assembly and the mating connector from being easily separated. One such arm may be provided for the connector using only one of the upper or lower grounding plates 310, 320, or two may be formed.

Two upper shell plate protuberances 314*a* protrude downward from rear portions of the side portions of the upper shell plate 310 behind the elastic arms 316, so that the upper shell plate protuberances 314*a* can be inserted in the first stacking protuberances 408. Since each of the first stacking protuberances 408 described above is connected with the side wall 258, each of the upper shell plate protuberances 314*a* is inserted between the side wall 258 and the first stacking protuberance 408.

Two upper shell attachment pieces 414*a* are formed at the side portions of the upper shell plate 310. Each of the upper shell attachment pieces 414*a* is formed between the upper shell plate protuberances 314*a*, has a width corresponding to the width of the second stacking protuberance 412, that is, a width which enables the upper shell attachment piece 414*a* to be inserted between the two third stacking protuberances 406, and protrudes downward and then bends sideward to form a shape of the letter L.

Since each upper shell attachment piece 414*a* has a width which enables the upper shell attachment piece 414*a* to be inserted between the two third stacking protuberances 406 and has a shape of the letter L, the upper shell attachment piece 414*a* is attached to the side surface of the side wall 258 and the upper surface of the second stacking protuberance 412 and is then inserted in the clamp groove 410 of the stacking member 400. Lower shell attachment pieces 414*b* of the lower shell plate 320 are attached and assembled in the same way as described above, which will be described later.

The rear portion of the upper shell plate 310 has an angular shape corresponding to the shape of the upper body grip 216. The lower shell plate 320 is very similar to the upper shell plate 310, and the lower shell plate 320 has the lower grounding arm 322 having a central portion protruding upward, preferably in a shape of an inverted U, although other shapes may be used to provide the contact function to the grounding arm.

Since the lower grounding arm 322 protrudes upward as described above, the lower grounding arm 322 is inserted through the lower grounding hole 264 and electrically connected to the grounding node 114, thereby enabling the connector assembly to be grounded. Therefore, when the grounding shell 300 is assembled, the upper grounding piece 312 of the upper shell plate 310 of the grounding shell 300 is inserted through the upper grounding hole 212 of the upper body 210 and connected with the upper surface of the grounding node 114 located in the housing, and the lower grounding piece 322 of the lower shell plate 320 of the grounding shell 300 is inserted through the lower grounding hole 264 of the lower body 250 and connected with the lower surface of the grounding terminal 114 located in the housing. Therefore, the upper grounding arm 312, the grounding terminal 114, and the lower grounding arm 322 overlap on each other and are then spot-welded to each other, thereby forming a threefold arrangement.

In the meantime, the connection bridges 330 are formed between the front ends of the upper and lower shell plates 310 and 320. The connection bridges 330 take the shape of four strips which cooperate with the upper and lower shell plate 310, 320 to define openings corresponding to the mating holes 260, through which pins of a mating connecter.

The stacking means is an element for stacking a plurality of connector assemblies together to form a unit in accordance with the principles of the present invention. The staking means comprises a stacking member 400 which includes at least one clamp 401 having a separation surface 402 and the clamp groove 410, the first stacking protuberances 408, the second stacking protuberance 412, and the third stacking protuberances 406 of the lower body 250 of each connector assembly, and the upper shell attachment pieces 414*a* and the lower shell attachment pieces 414*b* of the upper shell plate 310 and the lower shell plate 320 of the grounding shell 300 of each connector assembly.

Each clamp 401 is made from synthetic resin, and is assembled behind the wing 266 of the lower body 250, and has its clamp groove 410 extending in the longitudinal direction inside of the clamp 401. Each of the clamp grooves 410 has a shape capable of receiving the second stacking protuberance 412 and the third stacking protuberances 406.

In the stacking member 400, the separation surfaces 402 of the clamps 401 are attached to each other, so that the clamps 401 extend in parallel to each other and are vertically stacked on each other. Therefore, the stacking member 400 may include a necessary number of clamps 401, the separation surfaces 402 of which are attached to each other, corresponding to the number of connector assemblies for high-speed communication cables. Since each clamp 401 is made from synthetic resin, each clamp 401 can be easily separated from other the clamps 401 of the stacking member 400 by a cutter according to the user's necessity. For example, the stacking member 400 initially manufactured may have six clamps 401 attached to each other, which can be separated from each other by a cutter according to the number of connector assemblies for high-speed communication cables.

In stacking the connector assemblies by means of the stacking member 400 as described above, the upper body 210 and the lower body 250 are first assembled with each other, and then the grounding shell 300 is assembled with the assembled housing. In this case, the upper shell attachment pieces 414*a* and the lower shell attachment pieces 414*b* formed at rear portions of the upper and lower shell plates 310 and 320 are located on the outer surfaces of the side walls 258 of the lower body 250 and the upper and lower surfaces of the second stacking protuberances 412.

Thereafter, each second stacking protuberance 412 together with the upper shell attachment pieces 414*a* and the lower shell attachment pieces 414*b* is inserted in the clamp groove 410 of the stacking member 400. In this case, the third stacking protuberances 406, the second stacking protuberance 412, and the upper shell attachment pieces 414*a* and the lower shell attachment pieces 414*b* in contact with the upper and lower surfaces of the second stacking protuberance 412 are located in the clamp groove 410.

Since a plurality of the clamps 401 can be attached to each other via the separation surfaces 402 and easily separated from each other by a cutter, a plurality of the clamps 401 attached together as one stacking member 400 can be simultaneously assembled with a necessary number of connector assemblies after the connector assemblies are stacked on each other.

Since the stacking member 400 includes the clamps 401 attached to each other when the stacking member 400 is initially manufactured, a necessary number of connector assemblies can be easily assembled together by stacking the connector assemblies, assembling the clamps 401 of the integrated stacking member 400, and then separating redundant clamps 401 from the assembled clamps 401.

Hereinafter, a method of assembling connector assemblies for high-speed communication cables according to the present invention will be described. First, a user strips a coat from end portions of multiple cables 12 and connects grounding wires to each other. Thereafter, the cables 12 are spaced at necessary intervals from each other, and then the cables 12 except for the stripped portions are fixed by insert-molding, so that the cables 12 are held at their regular positions.

Then, the stripped portions of the lead wires 12*a* are spot-welded to ends of the terminals 12. The cable holder 100 and the terminals nodes 112 connected by spot-welding in this way are seated in the upper body plate 218 and the terminal seats 262 of the lower body 250, respectively. In this case, since the cable holder 100 has the holder-assembling protuberances 102 protruding from the upper and lower surfaces of the cable holder 100, the holder-assembling protuberances 102 are inserted in the holder-assembling holes 214 of the lower body 250, so that the cable holder 100 can be held at its regular position in the lower body 250.

Thereafter, the holder-assembling protuberances 102 protruding from the upper surface of the cable holder 100 are inserted in the holder-assembling holes 214 of the upper body 210, so that the upper body 210 and the lower body 250 are assembled together. Then, the assembled upper and lower bodies 210 and 250 are fused to each other by means of ultrasonic wave.

When the ultrasonic wave fusion is completed, the upper shell plate 310 and the lower shell plate 320 of the grounding shell 300 are opened, the assembled housing 210 and 250 is located deeply in the grounding shell 300, and then the upper shell plate 310 and the lower shell plate 320 of the grounding shell 300 are closed. In this state, welding electricity is applied to the upper grounding piece 312 of the upper shell plate 310, so that the upper grounding arm 312, the grounding terminal 114, and the lower grounding arm 322 in a threefold arrangement are spot-welded to each other.

Finally, the clamp 401 is assembled with the first stacking protuberances 408, the second stacking protuberance 412, and the third stacking protuberances 406 disposed at rear portions of the housing 210 and 250, so that one connector assembly for a high-speed communication cable according to the present invention is manufactured.

Meanwhile, in order to manufacture a unit, or lamination, of multiple connector assemblies, the connector assemblies are stacked on each other, and then the stacking member 400 including at least the same number of clamps 401 attached to each other is assembled with the first stacking protuberances 408, the second stacking protuberance 412, and the third stacking protuberances 406.

In a connector assembly for a high-speed communication cable according to the present invention as described above, elements of the connector assembly can be collectively assembled after being individually manufactured, and then the connector assembly can be stacked on and assembled with other connector assemblies having the same construction. Also, according to the present invention, cables can be located and held at their regular positions in the connector assembly, thereby preventing defective connection. Moreover, in a connector assembly for a high-speed communication cable and a manufacturing method thereof according to the present invention, the final insert-molding step of the conventional method is replaced by an assembling step, thereby reducing the manufacturing cost, simplifying the manufacturing process, and improving the productivity.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A high-speed connector for connecting at least one cable to a mating connector, the cable having a plurality of signal conductors and at least one grounding conductors therein, comprising:

a holder for holding a free end of the cable in a preselected position;

a plurality of conductive signal terminals and one ground terminal, each signal and ground terminal including a termination end and a contact end disposed at opposite ends of the terminal for terminating to said cable signal and ground conductors;

an insulative housing formed from interengaging upper and lower body portions, the housing having a mating face for mating with the mating connector and a cable face for engaging said cable, the upper and lower body portions cooperatively holding the cable holder and said terminals in place within the housing, the upper body portion having an upper grounding hole extending through said upper body portion, the lower body portion including a lower grounding hole extending through the lower body portion;

said housing further including a plurality of mating openings formed along the mating face thereof, each of the mating openings communicating with a single terminal of said connector; and, a grounding shell substantially surrounding the upper and lower body portions of said housing and including a plurality of openings formed by connective bridges that extend between an upper plate and a lower plate of the grounding shell, the plurality of openings formed thereby corresponding to and aligned with said housing mating openings, said grounding shell further including grounding arms that electrically and mechanically contact said grounding terminal within said housing, thereby providing a grounded shell substantially enclosing said connector, at least one of the grounding arms of the grounding shell is in electrical and mechanical contact with the grounding terminal so as to maintain the grounding shell at a reference potential thereby providing an electrical shield that substantially surrounds signal terminals enclosed in said connector.

2. A connector as claimed in claim 1, wherein said housing lower body portion includes a plurality of sidewalls disposed thereon and extending longitudinally within said lower body portion to define a plurality of terminal-receiving partitions, said terminals being disposed in the terminal-receiving partitions.

3. A connector as claimed in claim 1, wherein said housing upper body and the lower body portions are joined to each other by ultrasonic welding.

4. A connector as claimed in claim 1, wherein said housing upper and lower body portions include a plurality of assembly holes, and said cable holder includes a plurality of assembly posts projecting therefrom, the assembly posts being received within said assembly holes , thereby fixing said cable holder in said housing.

5. A connector as claimed in claim 1, wherein said cable has a plurality of cable wires are joined to said terminals.

6. A connector as claimed in claim 1, wherein said upper and lower grounding arms contact said grounding terminal from opposite sides thereof to define a three layer grounding connection.

7. A connector as claimed in claim 1, wherein said upper and lower grounding plates each have a length that extends between said housing mating face and said cable holder.

8. A connector as claimed in claim 7, wherein said upper and lower grounding plates have equal lengths.

9. A connector as claimed in claim 1, wherein said upper and lower grounding arms are formed in respective center portions of said grounding shell upper and lower grounding plates.

10. A connector as claimed in claim 1, wherein at least one of said grounding shell upper and lower grounding plates include an elastic flap formed thereon and oriented transversely thereto for contacting a transverse portion of said mating connector.

11. A connector as claimed in claim 1, wherein each of said grounding shell upper and lower grounding plates includes an elastic flap formed thereon and oriented transversely thereto for contacting a transverse portion of said mating connector.

* * * * *